United States Patent [19]

Bazan

[11] 4,259,791

[45] Apr. 7, 1981

[54] SKIER'S TOE AND FOOT INSULATOR

[76] Inventor: Anthony C. Bazan, 247-A Fleming Rd., Charleston, S.C. 29412

[21] Appl. No.: 127,185

[22] Filed: Mar. 4, 1980

[51] Int. Cl.[3] ..... A43B 3/18; A43B 5/04

[52] U.S. Cl. ..... 36/7.2; 36/117

[58] Field of Search ..... 36/7.2, 2 R, 117, 136

[56] References Cited

U.S. PATENT DOCUMENTS

| | | | |
|---|---|---|---|
| 1,037,201 | 9/1912 | Brown et al. | 36/7.2 |
| 4,069,599 | 1/1978 | Alegria | 36/7.2 |

*Primary Examiner*—Patrick D. Lawson

[57] ABSTRACT

This article insulates the toes and feet of a cross-country (Nordic) skier when it is secured in position atop the forward part of the ski boot by strap means and by the clamping effect of the bail of the ski binding on the tongue section of the article. The article consists of two fabric components, an upper and a lower, attached at their front and lateral edges. They are shaped and dimensioned to fit over the forward part of the boot upper and to contain a pad of insulation between them. The tongue section is an extension of the two components beyond the toe end of the boot upper; it contains no insulation. A first strap, attached to the insulator, extends over the insulator and beneath the boot sole to hold the insulator in position against the boot upper. A second strap extends around the heel of the skier's boot and also serves to hold the insulator in position.

6 Claims, 6 Drawing Figures

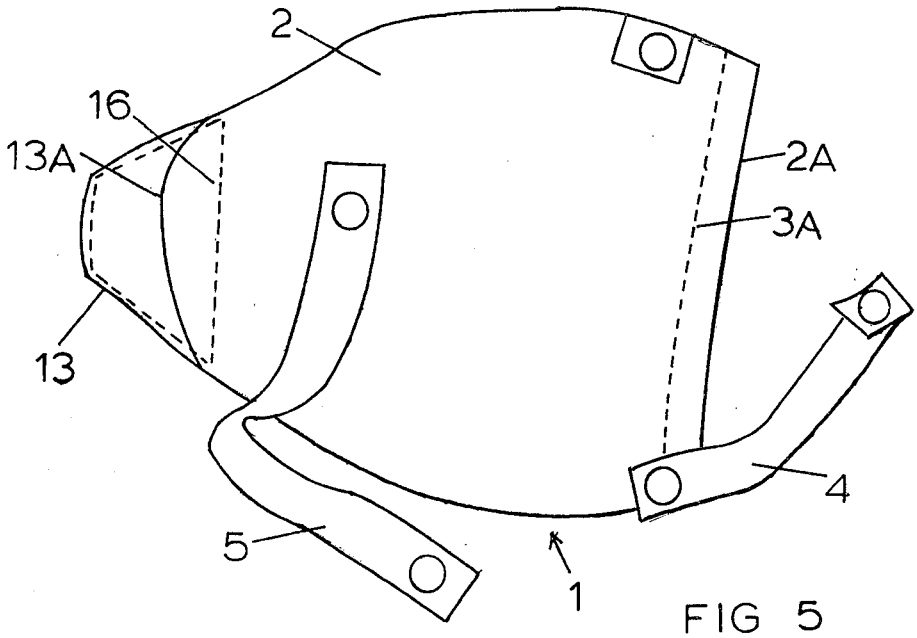
FIG 5
FIG. 6
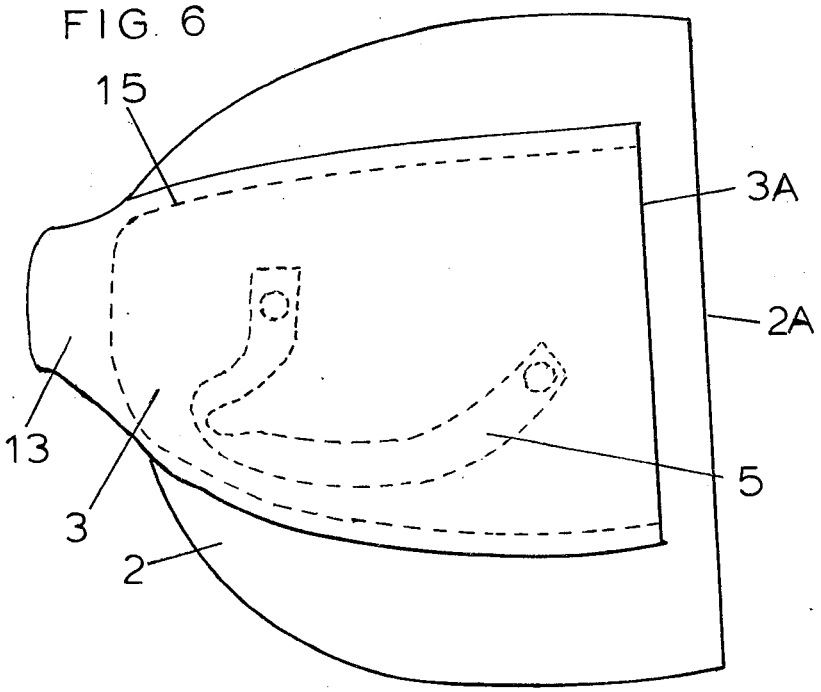

SKIER'S TOE AND FOOT INSULATOR

BACKGROUND OF INVENTION

This invention relates to insulative apparel for the foot and more specifically to an insulator to be detachably secured atop the forward portion of the boot of a cross-country (Nordic) snow skier to provide added protection to the toes and foot from cold air and snow.

The motions of a skier's foot during cross-country skiing are such that they require a flexible boot, the toe of which is attached to the ski's midpoint by means of a binding as illustrated in FIGS. 1, 2, 3, and 4. The common pin binding 8 includes a bail 9 which securely clamps an extension 7 of the sole of the boot 6 into the binding 8 and thus onto the ski 10. The binding 8 also has metal pins 11 (see FIG. 4) which fit into holes in the underside of the sole extension 7 to help hold the boot in position.

The cross-country ski boot which meets the above requirement of flexibility is often necessarily deficient in built-in insulation. Many cross-country skiers suffer extreme discomfort and even frostbite of the toes when wearing well-made lined boots and thick socks. The toes and other extremities are especially susceptible to chilling because of physiological mechanisms which reduce circulation to them in order to conserve heat for more vital body organs.

The inclusion of multiple layers of socks between the foot and the boot has the limitation that it seriously restricts toe movement, and further reduces blood circulation to the toes. Thus, adding more layers of socks may result in colder toes. The substitution of a layer of thin plastic socks may reduce heat loss through evaporative cooling; but, considerable amounts of undissipated perspiration from sustained exercise is uncomfortable and disconcerting to many people.

A sound approach to the problem of maintaining the warmth of the feet and toes is that of the addition of insulation onto the exterior of the boot. Such a means does not have the disadvantages mentioned above, namely restriction of toe movement or retention of perspiration. Furthermore, this approach offers versatility; the insulation may be easily applied or removed as necessary.

Previously devised foot muffs, over-boots, and shoe protectors do not seem appropriate for the purpose of insulating the toes of a cross-country skier while accommodating the structural requirements of the present day ski boot and binding. Particularly inappropriate for the stated purpose is the inclusion of soles in the garment. These could interfere with fitting the boot in the binding 8, alignment of binding pins 11 with holes in the boot sole extension 7, etc. Furthermore, the installation over the ski boot of an overgarment with soles requires the removal of the boot 6 from the binding 8. Reinstallation of the boot in the binding usually requires removal of snow from the binding and boot sole prior to realignment of the holes in the boot sole extension 7 with the binding pins 11. These operations are obviously an inconvenience to the skier.

Accordingly, the object of my invention is the provision of a conveniently attachable and detachable durable insulator specifically designed to insulate the toes and foot while accommodating the structural requirements of a cross-country ski boot and binding. Further objects will become apparent from a consideration of the drawings and ensuing description thereof.

DESCRIPTION OF DRAWINGS

This invention will be more fully understood from the following detailed description together with the drawings in which:

FIG. 5 is a top view of the insulator 1 showing the attached straps, 4 and 5.

FIG. 6 shows the top component 2 and bottom component 3 of the insulation envelope indicating their relative shape and size and positioning prior to attachment of the front and lateral edges to each other. The instep strap 5 is shown attached to what will become the top-exterior surface of the insulator 1.

DESCRIPTION OF PREFERRED EMBODIMENTS

Figure 1:
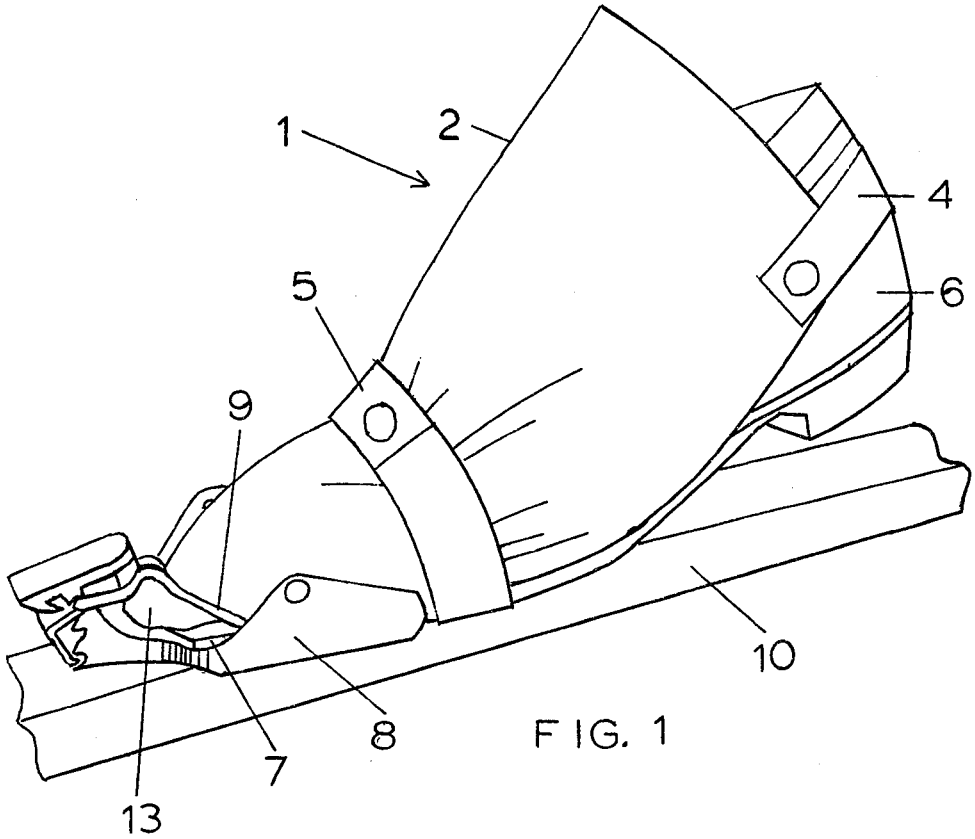
FIG. 1 is a perspective view of the insulator 1 embodying this invention which is held in position over the front of a ski boot 6 by means of the instep strap 5 and heel strap 4, which are a part of the invention, and the clamping action of the bail 9 which is part of the ski binding 8.
Figure 2:
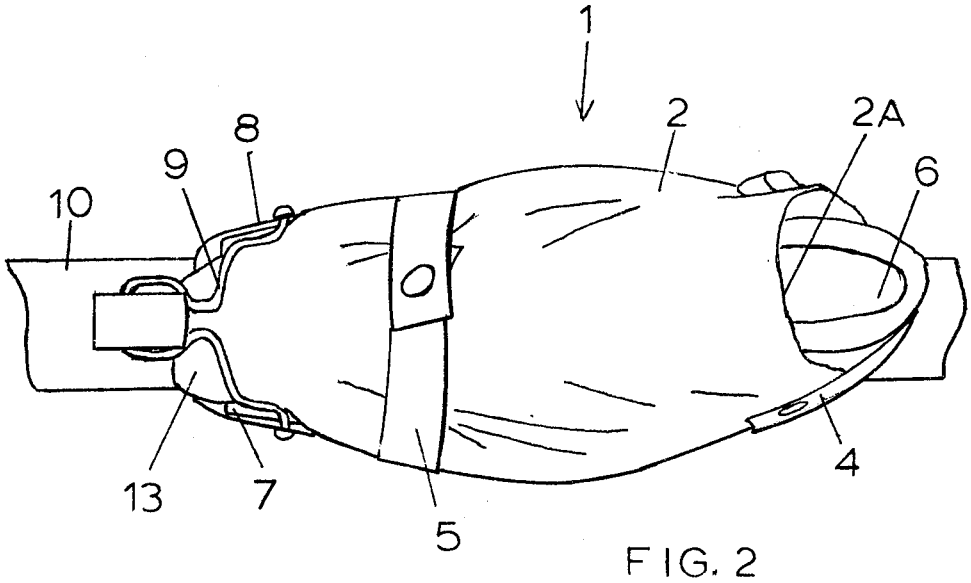
FIG. 2 is a top view of the insulator 1 in position as in FIG. 1.
Figure 3:
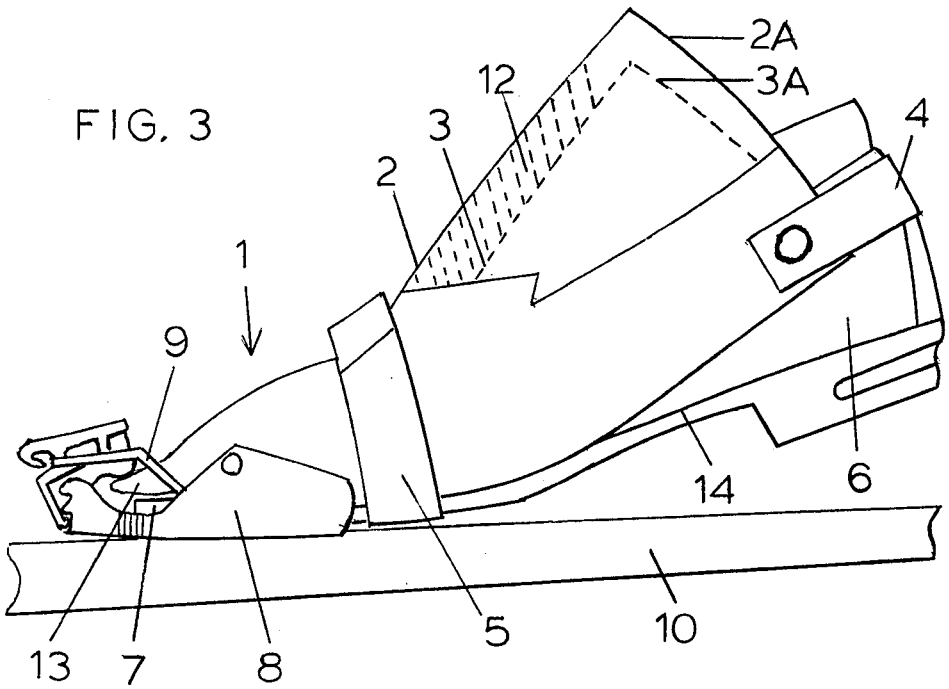
FIG. 3 is a side view of the insulator 1 in position as in FIGS. 1 and 2. A portion of the upper component 2 is cutaway to show the insulation 12 and the lower component 3.
Figure 4:
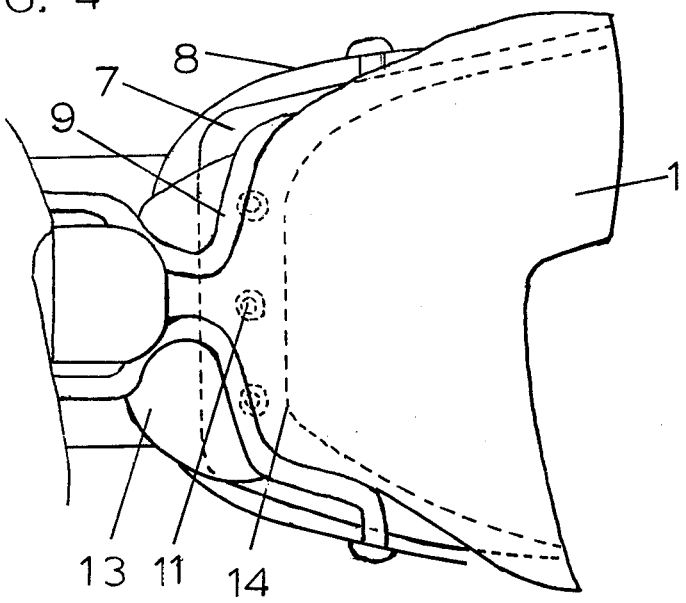
FIG. 4 is a more detailed top view of the front end of the insulator 1 as in FIG. 1. It shows the relationship between the tongue section 13, the boot sole extension 7, the bail 9 and pins 11 of the binding 8.

The insulator 1 atop shoe 6 in FIGS. 1–3 is an insulation 12 containing envelope, made of fabric and consisting of a top component 2 and a bottom component 3 permanently fastened to each other at their front and lateral edges; the rearmost edges 2A and 3A, may be detachably secured to each other or left unattached. The insulator has a tongue section 13 separated from the insulation containing part of the envelope by a line of stitches or other attachment 13A (see FIG. 5), and it has two straps, a heel strap 4 and an instep strap 5. The instep strap 5 holds the insulator in contact with the top portion of the boot by encircling the insulator and boot at a location forward of the instep. One end of the strap is permanently fastened to the top component 2 of the envelope; the other end is detachably secured at or near the fixed end after passing it under the sole and adjusting the tension. THe heel strap 4 helps hold the insulator in position and provides tension between the rear end of the insulator and the tongue section 13 which is securely clamped between the top of the boot sole extension 7 and the bail 9 of the binding 8. One end of the heel strap is permanently fastened near one of the rear corners of the envelope; the other end is then detachably secured near the other corner after passing it behind the boot heel and adjusting the tension.

The skier installs an insulator by placing it over the forward part of the ski boot, clamping the tongue section 13 between the bail 9 and boot sole extension 7, and then fastening the heel strap 4 and instep strap 5.

The following paragraphs describe the fabrication of an insulator 1 in FIGS. 1–3. The upper and lower components, 2 and 3, of the insulation envelope 1 may be made from any of a number of durable fabrics such as nylon, ripstop nylon, cotton/polyester, etc. The size and shape of the lower component 3 of an insulator for a particular size range of boots can be determined by first marking the fabric cover over the forward part of the boot welt 14 as the fabric is held in contact with the top surface of the boot. A pattern for an entire size range can be determined by using a boot in the middle of the size range. The length of the component 3 is such that it covers the boot toe, instep, and the front half of the opening for insertion of the foot into the boot. Before the component 3 is cut out, the lateral dimensions are extended ½ inch (1 cm) beyond the outline 15 (see FIG. 6) of the welt 14 to allow a margin for stitching or attachment by other means. Also, the outline at the toe end is extended approximately 2 inches (5 cm) to allow for the tongue portion 13 of the insulator which is clamped by the bail 9.

The size and shape of the upper component 2 of the insulation envelope is easily determined by using components 3 as a guide once it has been cut out of the fabric (see FIG. 6). The tongue sections of the two components are superimposable; but, the sides of the upper component 2 are each extended approximately 1½ inches (4 cm) as indicated (see FIG. 6) to allow for the insulation between the components. The total length of the upper component 2 is approximately ¾ inch (2 cm) greater than the lower. This allows the rear edge 2A of the upper component to contact the forward part of the skier's leg, thus keeping out snow and lending a more streamlined appearance.

Before the components are attached to each other along the edges (by sewing or other means), one end of the instep strap may be attached to the upper component 2 (see FIG. 6). The strap should be sufficiently long (see below) and should be attached to the surface which will be top/exterior at a point centered and approximately ⅓ of the way back from the forward end of component 2. It may be sewn, riveted or attached between the components of a snap assembly, or attached by some other means. If it is riveted or attached with the components of a snap, a small piece of thick fabric should be used as a "washer" between the rivet and the fabric of the component 3 to prevent the rivet or snap from pulling through the fabric. Also, the attached end of the strap should be doubled over to prevent the rivet or snap from pulling through the end of it. A hem of approximately ⅜ inch (1 cm) may be sewn into the rear edges 2A and 3A to prevent unraveling of these exposed edges.

Next, the forward and lateral edges of the components 2 and 3 of the envelope are sewn or permanently attached together by some other means. As indicated in FIG. 6, they may be attached to form an inside-out envelope. The envelope is next inverted, bringing the strap 5 outside to its proper location and forming an insulator for the boot opposite to the one traced. A line of stitches 13A is now installed across the toe end of the insulator near the welt line 14 to separate the tongue section 13 from the rest of the envelope.

The size and shape of a pad of insulation 12 is determined by using the perimeter of the envelope as a guide. The insulation may be dacron, wool, Thinsulate®, or some other suitable insulation material. The pad is inserted into the envelope. The rear of the envelope may be left open or fitted with a button or snap or other means of closure.

The next steps are the determination of strap lengths, securing means of reversible attachment of strap ends, and attachment of the heel strap 4. The straps may be of elastic (rubber/nylon), strong fabric or leather. The length of the instep strap is such that it holds the insulator securely in place while not excessively compressing the insulation (approximately 10–12 inches, 30 cm). Attached to the doubled over free end is a snap (or more than one snap) or piece of Velcro® which mates with its counterpart attached earlier at the fixed end. Methods other than snaps or Velcro® (e.g. buckles) could be employed; however, several snaps or Velcro® offer adjustability and ease of manipulation by cold hands.

One end of the heel strap 4 is permanently fastened at or near the rear corner of the insulator 1. The strap's length (approximately 5 inches, 12.5 cm, snap to snap) is such that it can provide tension to the insulator when it is held in position over the boot by the binding and instep strap. Attached to the doubled over free end of the strap is a snap or piece of Velcro® that mates with its counterpart attached at or near the other rear corner of the insulator. This attachment is best on the outside corner of the insulator to avoid detachment of the strap by the other ski boot, etc., while skiing.

Although the above description contains many specificities, these should not be construed as limitations on the scope of the invention, but rather as an exemplification of a preferred embodiment thereof. Other variations are possible. For example, alternate instep and heel strap arrangements are possible. Permanent attachments of components to each other and of straps to the insulator could be accomplished by means other than those mentioned. The tongue section 13 could be laterally extended to enable the insulator to be used with the cable-type of cross country ski binding; it could be reinforced, or it could consist of an extension of only one of the components 2 or 3. A pouch 16 (FIG. 5) opening to the rear could be formed beneath the tongue section by attaching a piece of fabric along the front and lateral edges of the tongue section 13. This could be hooked over the boot sole extension 7 to secure the front end of the insulator when it is worn over the boot without the ski. The scope of this invention is therefore to be determined from the attached claims rather than the above detailed description.

What is claimed is:

1. An article (an insulator) adapted for detachably mounting atop a cross-country (Nordic) ski boot for providing additional insulation for the skier's toes and foot, comprising an insulation containing envelope dimensioned for fitting over and covering the portion of said ski boot forward of the skier's leg, made of two components of durable fabric, the lower of said components to be in contact with the boot upper and having the same shape of the foward portion thereof, but having a tongue section extending forward beyond the welt line at the toe end of said boot upper; the upper of said components being dimensioned wider relative to said lower component to accommodate said insulation between said components, and also having a tongue section superimposable with said tongue section of said lower component; means permanently attaching said components together at front and lateral edges to form said envelope, and along a line separating said tongue section from the remainder of said envelope; appropriate insulation dimensioned for inclusion in said envelope; and first strap means attached to said upper component to be approximately above the ball of the skier's foot and adapted to hold said insulator securely in place and in contact with said boot upper through encircling said insulator and said forward part of said ski boot; second strap means with ends attached near opposite rear corners of said envelope and adapted to fit around the heel of said ski boot to hold said insulator in position.

2. The insulator according to claim 1 wherein said tongue section is adapted to hold the front end of said insulator in position through being clamped between the bail of a pin-type ski binding and the boot sole extension or between the mounted component of a cable-type ski binding and said boot sole extension.

3. The insulator according to claim 2 wherein a pouch beneath said tongue section is attached by its forward and lateral edges and adapted to fit over said boot sole extension and secure the front end of said insulator to the boot when it is worn with or without the ski and binding.

4. The insulator according to claim 2 wherein said tongue section is composed of an extension of only one of the envelope components.

5. The insulator according to claim 4 wherein a pouch between said tongue section is attached by its forward and lateral edges and adapted to fit over said boot sole extension and secure the front end of said insulator to the boot when it is worn with or without the ski and binding.

6. The insulation according to claim 1, with or without said tongue section and using hook or similar means to secure the front end of said insulation envelope to said ski binding.

* * * * *